US008832968B2

(12) United States Patent
Terrida

(10) Patent No.: US 8,832,968 B2
(45) Date of Patent: Sep. 16, 2014

(54) DEVICE FOR THE REPLACEMENT OF THE REMOVABLE HEEL, PROVIDED WITH PULLING ENGAGEMENT DEVICES, IN A SHOE WITH REMOVABLE HEEL

(76) Inventor: Alessia Terrida, Montebelluna (IT)

( * ) Notice: Subject to any disclaimer, the term of this patent is extended or adjusted under 35 U.S.C. 154(b) by 719 days.

(21) Appl. No.: 13/174,991

(22) Filed: Jul. 1, 2011

(65) Prior Publication Data

US 2012/0066845 A1 Mar. 22, 2012

(30) Foreign Application Priority Data

Sep. 20, 2010 (IT) ..... TV2010A0126
Nov. 4, 2010 (IT) ..... TV2010R0127

(51) Int. Cl.
*A43B 21/50* (2006.01)
*A43B 21/51* (2006.01)

(52) U.S. Cl.
CPC ..... *A43B 21/50* (2013.01); *A43B 21/51* (2013.01)
USPC ..... 36/36 C; 36/42

(58) Field of Classification Search
CPC ..... A43B 21/51; A43B 21/50
USPC ..... 36/36 C, 42
See application file for complete search history.

(56) References Cited

U.S. PATENT DOCUMENTS 895,924 A * 8/1908 White ..... 36/36 C
1,414,545 A * 5/1922 Boswell ..... 36/36 R
1,432,340 A * 10/1922 Jurris ..... 36/36 C
1,584,983 A * 5/1926 Eichorn ..... 36/39
1,588,684 A * 6/1926 Mayorowitz ..... 36/36 C
1,633,449 A * 6/1927 Mayorowitz ..... 36/36 C
1,642,951 A * 9/1927 Harrison ..... 36/36 A
1,885,341 A * 11/1932 Grauert ..... 36/42
1,949,346 A * 2/1934 Bain ..... 36/36 R
1,959,721 A * 5/1934 Kohler et al. ..... 36/42
1,986,727 A 1/1935 Hall, Jr.

FOREIGN PATENT DOCUMENTS

IT 1160651 B 3/1987
IT TV2009U000041 U1 10/2009
WO 9605394 A1 2/1996
WO 2008125705 A1 10/2008

* cited by examiner

*Primary Examiner* — Ted Kavanaugh
(74) *Attorney, Agent, or Firm* — Egbert Law Offices, PLLC

(57) ABSTRACT

Device for the replacement of the removable heel provided with pulling engagement devices in a shoe with removable heel including, associated to the heel-holding sole, a first engagement plate with hooking seats provided with guide slot and guide opening for the engagement of the head of a pulling pin as well as of a first engagement wall and a second engagement wall among which the guide opening is arranged, being the first engagement plate provided with an engagement pin and at least one guide seat, being a second engagement plate joined to the upper part of the removable heel and equipped with pulling pins, provided with head and spring, being the second engagement plate, for the association to the first engagement plate, provided with at least one small peg, through seats and through opening.

7 Claims, 3 Drawing Sheets

DEVICE FOR THE REPLACEMENT OF THE REMOVABLE HEEL, PROVIDED WITH PULLING ENGAGEMENT DEVICES, IN A SHOE WITH REMOVABLE HEEL

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to a device for the replacement of a removable heel, provided with pulling engagement devices, in a shoe with removable heel.

The invention finds specific, however not exclusive application, in the shoe manufacturing industry and shoe accessory industry.

2. Description of Related Art Including Information Disclosed Under 37 CFR 1.97 and 37 CFR 1.98.

Specifically developed shoes for foot care have been known and used for a long time as protection devices during movements and walking From their conception, said devices evolved into many different styles, both in terms of structural implementations and in terms of design. In brief, the basic structure of a shoe, necessarily consists of at least one lower part, namely a sole meant for ground contact, and at least a top part, anchored to the sole, conventionally called an upper, produced to bind up the foot and guarantee that the shoe remains associated with the foot when walking and preventing the foot from contacting the ground. Especially in women shoes, the sole portion coinciding with the heel is provided with a shim portion, conventionally called a heel, of variable height according to the shoe style it is produced for. Some women shoe styles make it possible to remove and replace the heel with one of different height or shape.

State of the Art

The current technical scenario offers many removable-heel shoes. The removable-heel shoes cited in the patent literature include, with merely illustrative and non-comprehensive purpose, the following:

D1: n. WO9605394 (Goldenberg)

D2: n. WO2008/125705 (Gòmez)

D3: n. IT1160651 (Waldemar)

D4: n. U.S. Pat. No. 1,986,727 (Hall)

D5 n. TV2009U000041 (Terrida) (Oct. 26, 2009)

D1 describes a shoe with an interchangeable heel including a pin protruding from the head portion of a sole provided with a housing to accommodate a screw, which is to screw a nut drowned in an appropriate housing at a prearranged head element. Furthermore, an interchangeable heel is provided with an appropriate capsule-type anchoring device, which can be inserted in a suitable seat provided in the heel. Said anchoring capsule includes an expansion device through which the anchorage of the heel to the shoe sole is performed.

D2 describes a shoe with removable heel briefly characterized in that it can be divided in two associable parts, one of which comprising the heel, which is associated to the shoe through a track arranged for anchoring the heel to the heel-holding sole of the upper part of the shoe. Said heel is provided with two L-shaped sheets, both connected to a ring-shaped element, being said sheets located at the upper part of the heel. The upper part of the shoe meant to engage the heel is provided with two grooves suitable for engaging said L-shaped sheets at the heel.

D3 describes a heel application system in shoes with interchangeable heel, characterized in that the first part of the sole, shows in its back part a rigid supporting plate fixed thereon and, both the first part of the sole and the plate are cut at each other's front, the cut on the plate being however of smaller dimension than the one on the sole and one of said cuts showing at least a straight plane, and the heel being provided at its upper part with a protrusion, the heel and the first part of the sole being joined by means of connection means that can be detached or screwed.

D4 describes a removable heel solution for shoes comprising a flat engagement body anchored to the shoe, said flat body being externally provided with a circular guiding plate provided with a number of radially arranged anchoring flaps, next to the base of said flat body. Furthermore, a separated heel is provided with a similar engagement device at said flat body, which is provided to be anchored to said heel being it equally provided with corresponding radial engagement openings, being the edge of the heel flat body thinner in correspondence with said openings in order to allow the reciprocal engagement of the seats and anchorage flaps at said flat bodies, for associating the heel to the shoe.

D5 briefly describes a shoe with removable heel provided with a device for the replacement of the removable heel comprising, associated to the shoe heel-holding sole, a first engagement plate provided with at least three bayonet hooking seats each provided with guide slot and provided with a groove for engaging the head of an engagement pin as well as at least a first engagement wall and a second engagement wall with a guide slot between them, being the first engagement plate provided with appropriate seats for its fixing to the shoe heel-holding sole, being a second engagement plate connected to the upper part of the removable heel and provided with engagement pins provided with head being the second engagement plate further provided with suitable through holes for its connection of the second engagement plate to the removable heel.

Drawbacks

The known background art underlines that all the described solutions determine drawbacks and constraints to a certain extent.

A first limitation involving all the currently known removable heel footwear solutions and their corresponding heel replacement devices, in the opinion of the applicant, consists in the detected circumstance that the engagement devices arranged to allow the association and removal of the heel are not optimized in terms of engagement stability, especially following the protracted use of the shoe. In particular, the currently known removable heel footwear solutions have been found not to be provided with specific devices able to ensure an optimal anchorage of the removable heel to the heel-holding sole, being it a stable anchorage at the same time allowing an easy removal of the heel.

A second limitation further involving all the currently known and shown removable heel solutions and the corresponding heel replacement devices, in the opinion of the applicant, consists in the detected circumstance that the solutions are not optimized in terms of heel association and removal at the shoe, such a circumstance having been found to limit the use of such footwear particularly if shoes are worn by users with no particular manual skills.

A further disadvantage involving the currently known footwear removable heel solutions and their corresponding heel replacement devices, in the opinion of the applicant, emerges in the detected circumstance that the solutions of the known art, not providing specific engagement devices able to correct and limit possible anchorage defects of the heel to the heel-holding sole, do not ensure an optimal connection stability able to be wearproof in the course of time and free from the need of successive replacement and maintenance operations.

Therefore, the footwear industry companies need to identify the optimal solutions to obtain the successive prearranged aims.

BRIEF SUMMARY OF THE INVENTION

These and other aims are achieved by the present invention technically solving the outlined issues by means of a device for the replacement of the removable heel (1) provided with pulling engagement devices in a shoe with removable heel comprising, associated to the heel-holding sole (3), a first engagement plate (2) with hooking seats (5) provided with guide slot (51) and guide opening (58) for the engagement of the head (71) of a pulling pin (7) as well as with a first engagement wall (56) and a second engagement wall (57) with the guide opening (58) between them, being the first engagement plate (2) provided with an engagement pin (4) and at least one guide seat (8), being a second engagement plate (6) jointed to the upside of the removable heel and equipped with pulling pins (7), provided with head (71) and equipped with spring (10), being the second engagement plate (6), for the connection to the first engagement plate (2), provided with at least one small peg (61), through-seats (62) and through-opening (65).

Aims

The considerable creative contribution, the effect of which constitutes an immediate technical progress, makes it possible to achieve aims and advantages not otherwise achievable at least in D1-D5.

A first advantageous aim is to develop a device for the replacement of removable heels provided with pulling engagement devices in a shoe with removable heel, the innovative structure of which allows to one obtain an optimal anchorage of the removable heel so as to ensure its engagement stability even after an intensive and protracted use of the shoe, in particular providing the removable heel replacement device with appropriate solutions equally able to ensure a stable engagement of the removable heel, especially during walking, and an easy removal of the removable heel.

A second advantageous aim is to obtain a removable heel replacement device provided with pulling engagement devices in a shoe with removable heel, the innovative structure of which allowing to effect an optimal and simplified anchorage and disanchorage of the removable heel so as to allow all users to quickly replace the removable heel simplifying the corresponding necessary operations.

A further advantageous aim is to develop a removable heel replacement device provided with pulling engagement devices in a shoe with removable heel, the innovative structure of which, particularly thanks to the predisposition of pulling engagement devices allows to compensate and limit possible anchorage defects of the removable heel to the heel-holding sole of the shoe especially due to repeated anchorage and disanchorage operations of the removable heel, in order to avoid or limit the need of replacement or maintenance operations.

These and other advantages will emerge from the following detailed description of an embodiment.

DETAILED DESCRIPTION OF THE INVENTION

Figure 1:
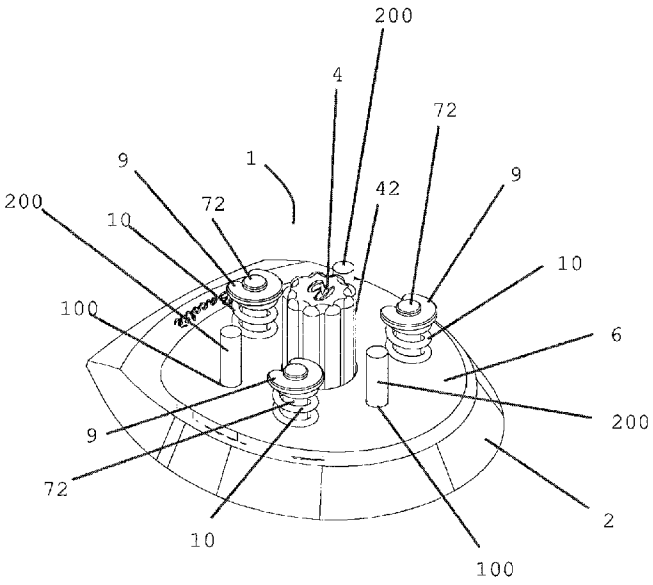
FIG. 1 is a schematic, ensemble axonometric view of the device for the replacement of the removable heel regarding the object of the present invention.
Figure 2:
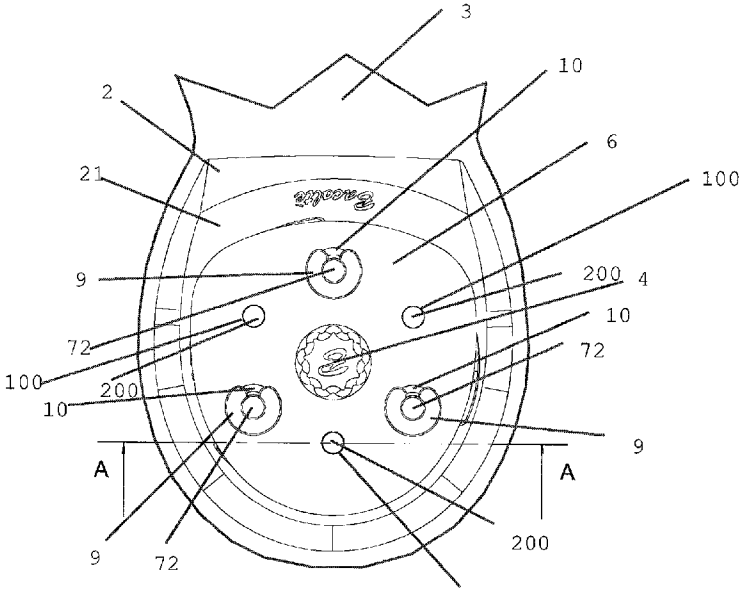
FIG. 2 is a plan view from above of the device for the replacement of the removable heel of the FIG. 1.
Figure 3:
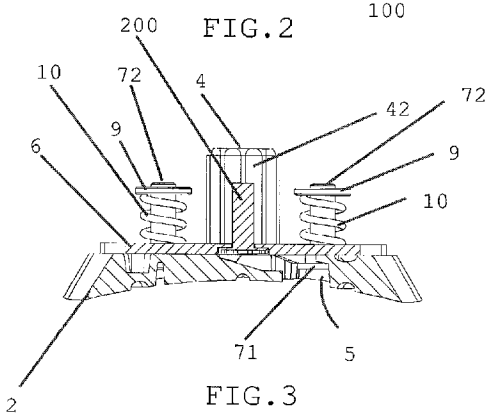
FIG. 3 is a sectional view along the A-A axis of the removable heel replacement device of FIG. 2.
Figure 5:
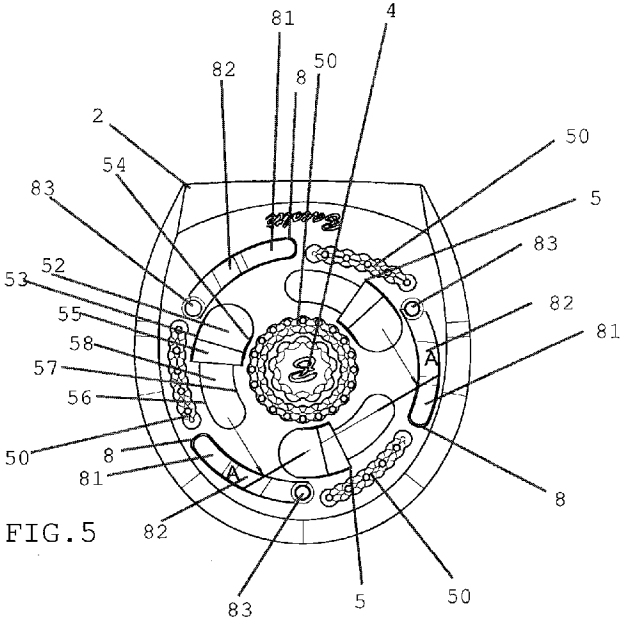
FIG. 5 is a plan view from above of the first engagement plate of FIG. 4.
Figure 6:
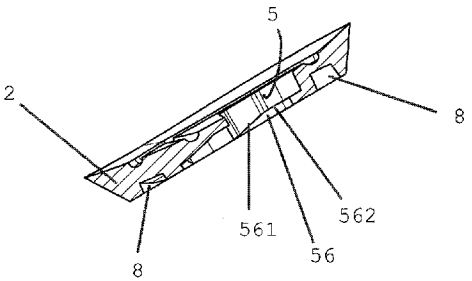
FIG. 6 is a sectional view along the A-A axis of the first engagement plate of FIG. 5.
Figure 4:
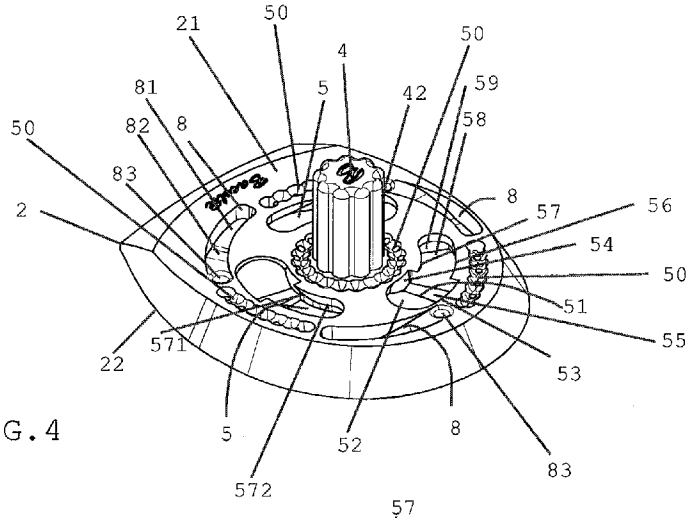
FIG. 4 is a schematic, axonometric three-quarter view from above of the first engagement plate of the device for the removable heel replacement regarding the object of the present invention.
Figure 7:
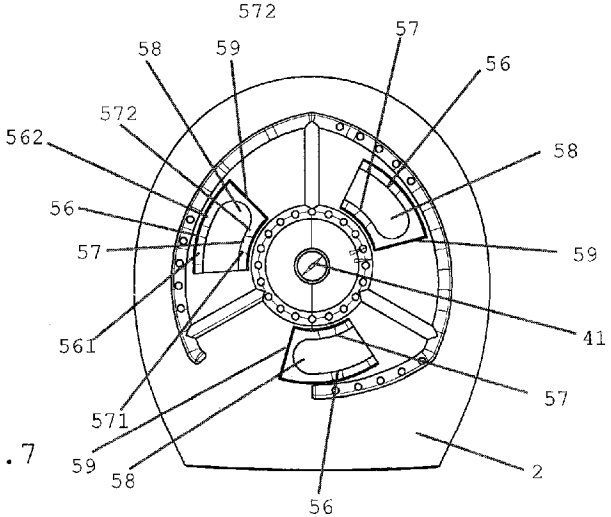
FIG. 7 is a plan view, from the bottom, of the first engagement plate of FIG. 4.
Figure 9:
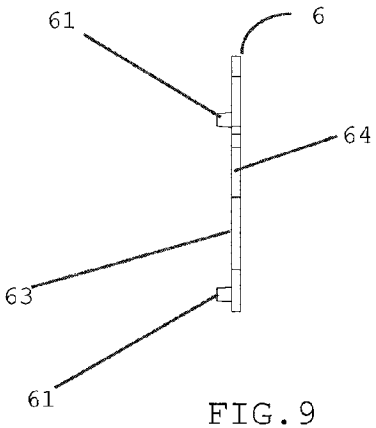
FIG. 9 is a side view of the second engagement plate of FIG. 8.
Figure 8:
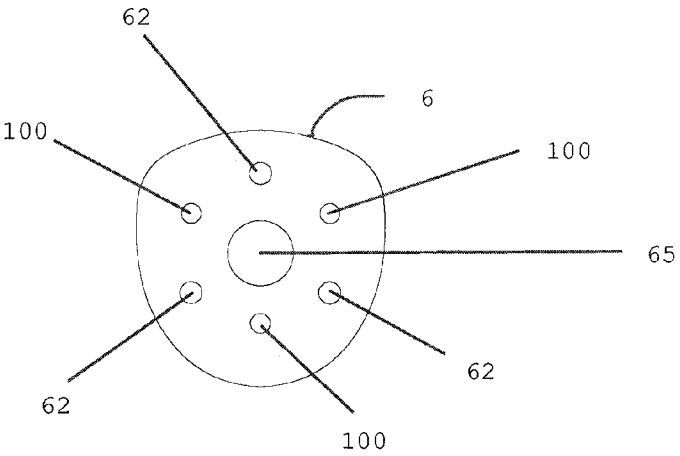
FIG. 8 is a plan view from above of the second engagement plate regarding the object of the present invention.
Figure 10:
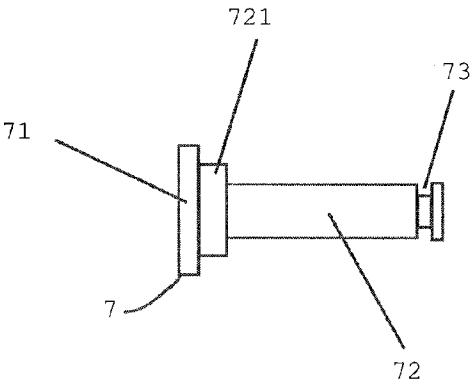
FIG. 10 is a side view of a pulling engagement device of the device for the removable heel replacement regarding the object of the present invention.

With further reference to the figures, a device is observed for the replacement of the removable heel (1) provided with pulling engagement devices, in a shoe with removable heel, which in the embodiment example described as preferred embodiment solution, as shown in FIGS. 1 to 10, includes a first engagement plate (2) opportunely associated with the back portion of the heel-holding sole (3) of the shoe, coinciding with the support zone of the foot heel, at which first engagement plate (2) a second plate of engagement (6) is opportunely associated, which is opportunely anchored to the removable heel, not shown, of the shoe. Analysing the details of the described embodiment, as shown in FIG. 2, the first engagement plate (2), provided with a lower face (21) and an upper face (22), is associated to the shoe heel-holding sole (3) conventionally by means of known fastening devices such as screws (200) or nails, being the upper face (22) in contact with the portion of the heel-holding sole (3) to which it is associated. The first engagement plate (2), in the described embodiment is preferably made of metal or metal alloy and in any case in any other suitable material, being of appropriate size and shape, so as to allow the association to the heel-holding sole (3) of the shoe, conventionally at its back portion, coinciding with the support portion of the foot heel, being the first engagement plate (2) preferably of lower area than the surface area of the heel-holding sole (3) to which it is associated at the association portion. The anchorage of the first engagement plate (2) to the back portion of the heel-holding sole (3) of the shoe, in the example, is provided to occur by means of gluing and screwing of at least one conventional screw (200) placed in correspondence with at least one provided threaded fixing seat (41) (FIG. 7) with which the engagement pin (4) is provided, being the first engagement plate (2) equipped with the engagement pin (4), in order to allow an optimal anchorage to the second engagement plate (6) and to the removable shoe heel. It is widely envisaged that, in order to be anchored to the back portion of the heel-holding sole (3), the first engagement plate (2) is however opportunely made in such a way to allow the engagement to the heel-holding sole (3) by means of known fastening devices such as screws (200), nails, adhesive means, and also the concurrence of them, the association of the first engagement plate (2) also occurring through its partial drowning in the structure of the heel-holding sole (3).

Furthermore, in order to allow the engagement of the second engagement plate (6) and the consequent anchorage of the removable heel, the first engagement plate (2) is provided with appropriate hooking seats (5), particularly for carrying out a bayonet-type hooking Preferably, as the described embodiment shows (FIGS. 4, 5, 6), the hooking seats (5) with which the first engagement plate (2) is provided, are in minimum number of three and preferably placed in a circle equidistant from each other and shaped in such a way that each one follows a semicircular fold feature in order to allow that the engagement of the second removable plate (6) also determines a semicircular movement in which the engagement pin (4) works as fulcrum. According to the details of the described embodiment, the hooking seats (5) are peripherally arranged in circle with respect to the engagement pin (4) which in this way, with respect to the hooking seats (5), is arranged in a central position and, in the example, consists of an opportunely shaped protruding pin, preferably cylindrically shaped with smooth perimetral wall (42) or, as in the described embodiment (FIGS. 4, 5), opportunely shaped, being further provided that peripherally at the base of the engagement pin (4), at the lower face (21) of the first engagement plate (2), a groove (50) is obtained, circular in the example, which is intended to be totally or partially filled with plastic or rubber material to constitute a support bearing for the second engagement plate (6), being it indifferently provided that on said groove (50) and for the same aim, a gasket can be placed in such a way that it results slightly protruding with respect to the surface of the lower face (21) and at least partly deformable to allow the compensation of possible clearances between the first engagement plate (2) and the second engagement plate (6) once the latter is associated with the first.

In further details, each hooking seat (5) of the first engagement plate (2) is arranged in such a way to include a guide slot (51) for the head (71) of a pulling pin (7) with which the second engagement plate (6) is provided, being the guide slot (51) of appropriate shape and size, suitable to allow the head (71) of the pulling pin (7), with which the second engagement plate (6) is provided, to be guided in the anchorage movement. The provided guide slot (51) (FIG. 4) of the hooking seat (5) is of open type, being directed towards the lower face (21) of the first engagement plate (2) and includes an oblique base wall (52) oriented towards the upper face (22) of the first engagement plate (2), besides the oblique wall (52) being a first side-wall (53) parallel and opposite to a second side-wall (54) which first side-wall (53) and second side-wall (54) follow the semicircular course of the hooking seat (5) where, in the described embodiment (FIGS. 4 and 5), a flat bottom wall (55) is arranged at the end portion of the oblique wall (52). Furthermore, each hooking seat (5) is said to include a first engagement wall (56) and a second opposite and parallel engagement wall (57), both originating from the orthogonal plane at the free end of the bottom wall (55), the first engagement wall (56) and the second engagement wall (57) lying on a top surface, staggeredly opposed with respect to the plane in which the bottom wall (55) lies. Between the first engagement wall (56) and the second engagement wall (57) the hooking seat (5) develops a guide opening (58) to allow the sliding and guiding of at least one part of the shaft (72) of the pulling pin (7), in particular of the step (721) of the shaft (72), being the distance between the first engagement wall (56) and the second engagement wall (57) lower than the distance between the first side-wall (53) and the second side-wall (54) of the guide slot (51). In order to allow the guide and the optimal engagement of the head (71) of the pulling pin (7) with which the second engagement plate (6) is provided, (FIGS. 4 and 6) the first engagement wall (56) and the second engagement wall (57) are shaped in such a way to provide an oblique portion (561, 571) and a contiguous flat portion (562, 572), the oblique portion (561, 562) originating from the end of the corresponding first engagement wall (56) and the second engagement wall (57) contiguous with respect to the first side-wall (53) and the second side-wall (54). Furthermore, in order to allow the engagement of the head (71) of the pulling pin (7), with which the second engagement plate (6) is provided, each hooking seat (5) is shaped in such a way to allow the head (71) of the pulling pin (7) to slide in contact with the oblique portion (561, 571) and the flat portion (562, 672) of the first engagement wall (56) and the second engagement wall (57), the hooking seat (5) being constructed in such a way to provide that the portion below the first engagement wall (56) and below the second engagement wall (57) is opportunely shaped in such a way to perform a discharged perimetral area delimited at least by a perimetral guide wall (59) and suitable to allow the passage of the head (71) of the pulling pin (7).

In order to optimally perform the anchorage of the second engagement plate (6) at the first engagement plate (2) the first engagement plate (2), at the lower face (21), is further provided with guide seats (8), in the described embodiment and preferably provided in number of three and arranged concentrically to the hooking seats (5). In detail, each guide seat (8) performs a semicircular groove provided with a flat base wall (81) and a contiguous inclined wall (82) whose inclination is opposed to the inclination of the oblique wall (52) of the engagement seat (5), being the inclined wall (82) with oriented inclination towards the lower face (21) and being the guide seat (8), at the base wall (81), such as to be sufficiently deep as to equal the height of a small peg (61) with which the second engagement plate (6) is provided, wherein the inclined wall (82) is such as to join the base wall (81) with the surface of the lower face (21) of the first engagement plate (2). At least one appropriate restraint seat (83) shaped in such a way to allow the engagement, with provision for removal, of the corresponding small peg (61) of the second engagement plate (6) is arranged in proximity to the end of the guide seat (8) corresponding to the end of the inclined wall (82) reaching the lower face (21) of the first engagement plate (2). In this way, it is possible that, during the association of the second engagement plate (6) with the first engagement plate (2), each small peg (61) with which the second engagement plate (6) is provided, is guided by the corresponding guide seat (8) of the second engagement plate (2) until it reaches and engages the provided restraint seat (83). In further details of the described embodiment (FIG. 4 and FIG. 5) the positioning of each guide seat (8) shall be appropriate, so as to allow the guiding of the small pegs (61) of the second engagement plate (6) and the insertion and engagement of the pulling pegs (7) on the engagement seats (5) in such a way to allow the correct insertion of the head (71) of the pulling pin (7) on the corresponding engagement seat (5).

Furthermore, between one guide seat (8) and the contiguous one, the lower face (21) of the first engagement plate (2) is equipped with at least one appropriate semicircular groove (50), in the described embodiment the grooves (50) being provided in number of three, which groove (50) being intended to be totally or partially filled with plastic or rubber material to develop a support bearing for the second engagement plate (6), a gasket being arranged indifferently on said groove (50) and for the same aim in such a way that it is slightly in relief with respect to the surface of the lower face (21) and is at least partly deformable so as to allow the compensation of possible clearances between the first engagement plate (2) and the second engagement plate (6) once the latter is associated with the first.

In order to allow the engagement and removal of the removable heel, the removable heel shall anchor, to the upper part, by means of known fastening devices such as nails or screws (200), the second engagement plate (6) which is provided for this purpose with appropriate through-holes (100) suitable for allowing the anchorage. In order to allow the optimal engagement of the second engagement plate (6) to the first engagement plate (2), allowing the second engagement plate (6) to anchor the pulling pins (7), the second engagement plate (6) is provided with appropriate through seats (62) conveniently placed in such a way that their positioning is opportunely such as to coincide with the positioning of the hooking seats (5) of the first engagement plate (2), being each through seat (62) provided in order to engage a pulling pin (7), free to slide inside the through seat (62), comprising a head (71) and a shaft (72). More in detail, the head (71) of the pulling pin (7) is preferably circular and of larger diameter than the shaft (72), which shaft (72) includes, immediately below the head (71), a step (721) of lower width than the head (71), the step (721) being cylindrical in the example and of larger diameter than the remaining part of the shaft (72) and lower than the diameter of the head (71), the diameter of the remaining part of the shaft (72) being slightly lower than the diameter of the through seat (62) of the second engagement plate (6). Furthermore, the pulling pin (7) at the end opposite to the head (71) is opportunely provided with an annular groove (73) constituting a seat for the engagement of a locking ring (9).

Once each pulling pin (7) is placed on the corresponding through seat (62) of the second engagement plate (6), in such a way that the head (71) and the step (721) protrude with respect to the first face (63) of the second engagement plate (6), from which the small pegs (61) also protrude, the step (721) of the pulling pin (7) is envisaged to be elastically tractioned in contact of the first face (63) of the second engagement plate (6) by means of a spring (10) interposed between the second face (64), opposite to the first face (63), of the second engagement plate (6) and the locking ring (9) placed in correspondence with an appropriate annular groove (73) with which the shaft end (72) of the pulling pin (7) is provided. In this way, following the engagement of the second engagement plate (6) on the first engagement plate (2), the pulling pin (7) is allowed to perform the appropriate movements to insert on the corresponding hooking seat (5) until the head (71) of the pulling pin (7) insists, by means of an appropriate tensile force with retaining purposes, on the first engagement wall (56) and the second engagement wall (57) of the hooking seat (5) and at the same time such to allow its release to remove the removable heel. Consequently, the removable heel, in order to allow the positioning of the second engagement plate (6) and the functionality of the pulling pegs (7) shall be conventionally provided with appropriate blind seats suitable to allow the positioning and movement of the shaft (72) of the pulling pin (7) provided with spring (10) and of the locking ring (9) meant for retaining the spring (10). Furthermore, in order to allow the positioning of the removable heel, the second engagement plate (6) is provided with a through opening (65) suitable for allowing the passage of the engagement pin (4) of the first engagement plate (2), the removable heel being equally provided with an additional blind seat suitable for allowing the engagement of the engagement pin (4).

Operatively, the constraint of the second engagement plate (6) is performed by means of the clutch of the head (71) of each pulling pin (7) on the corresponding hooking seat (5) of the first engagement plate (2), where the positioning of the second engagement plate (6) on the first engagement plate (2) requires that the small pegs (61) of the second engagement plate (6) are to be clutched each in coincidence with the corresponding guide seat (8). Proceeding with a semi-rotation movement of the second engagement plate (6) with the associated removable heel around the fulcrum represented by the engagement pin (4), which will be rotatably engaged to the through opening (65) of the second engagement plate (6) and to the blind seat of the removable heel, the small pegs (61) of the second engagement plate (6) can translate guided by the corresponding guide seat (8) of the first engagement plate (2) until each of them engages the corresponding restraint seat (83). Said semi-rotation movement allows the head (71) of the pulling pin (7) to engage the corresponding hooking seat (5) of the first engagement plate (2) in such a way that from a position in which the head (71) of each pulling pin (7) is placed in coincidence with the guide slot (51) of the corresponding hooking seat (5), the head (71) of each pulling pin (7) is obliged to engage the first engagement wall (56) and the second engagement wall (57) of the corresponding hooking seat (5) so that the semi-rotation movement imparted to the second engagement plate (6) forces the head (71) of each pulling pin (7) to persist first on the oblique portion (561, 571) of the first engagement wall (56) and the second engagement wall (57) of the corresponding hooking seat (5) and then on the flat portion (562, 572) of the first engagement wall (56) and the second engagement wall (57) of the corresponding hooking seat (5) each pulling pin (7) being elastically called back by the spring (10) so as to allow a sufficient adherence of the second engagement plate (6) to the first engagement plate (2) and allow that at the completion of the semi-rotation engagement movement of the second engagement plate (6) a correct reception of each small peg (61) of the second engagement plate (6) is performed on the corresponding restraint seat (83) of the first engagement plate (2). On the contrary, the release operation of the second engagement plate (6) and the associated removable heel will determine the need to perform a traction movement of the second engagement plate (6) until disengaging the small pegs (61) of the second engagement plate (6) from the retaining seats (83) of the first engagement plate (2) and, due to a successive semi-rotation movement contrary to the one performed for the engagement, it allows to release the head (71) of the pulling pegs (7) from the corresponding hooking seat (5) freeing in this way the removable heel.

REFERENCE (1) device for the replacement of the removable heel;

(2) first engagement plate, (21) lower face, (22) upper face;

(3) heel-holding sole;

(4) engagement pin, (41) threaded fixing seat, (42) perimetral wall;

(5) hooking seats, (51) guide slot, (52) oblique wall, (53) first side-wall, (54) second side-wall, (55) bottom wall, (56) first engagement wall, (57) second engagement wall, (58) guide opening, (59) perimetral guide wall;

(561, 571) oblique portion;

(562, 572) flat portion;

(6) second engagement plate, (61) small peg, (62) passing seats, (63) first face, (64) second face, (65) through opening;

(7) pulling pin, (71) head, (72) shaft, (721) step, (73) annular groove;

(8) guide seat, (81) base wall, (82) inclined wall, (83) retaining seat;

(9) blocking ring;

(10) spring;

(50) groove;

(100) through-holes (200) screws

I claim:

1. Device for the replacement of the removable heel provided with pulling engagement devices, in a shoe with removable heel of the type comprising a first engagement plate anchored to the heel-holding sole of the shoe, which first engagement plate is provided with hooking seats each of which is suitable to engage the head of a retaining peg with which a second engagement plate associated with the upper part of a removable heel is provided, characterised in that the first engagement plate is equipped with at least one hooking seat, with at least one engagement pin, with at least one guide seat and with at least one restraint seat and in that the second engagement plate is equipped with at least one through-opening in such a way as to pivot the engagement pin, the second engagement plate being provided with at least one small peg able to be guided by at least one guide seat and to engage at least one restraint seat of the first engagement plate and in which the second engagement plate is opportunely provided with at least one pulling pin suitable to engage at least one hooking seat of the first engagement plate, the pulling pin including at least one head, at least one shaft and engaging at least one spring in such a way as to keep elastically in traction the pulling pin, the second engagement plate being attachable and detachable from said first engagement plate.

2. Device for the replacement of the removable heel provided with pulling engagement devices, in a shoe with removable heel according to claim 1, characterised in that the second engagement plate comprises at least one through-seat engaged by at least one pulling pin whose shaft, free to slide on the through-seat, below the head comprises at least one step with a width smaller than the width of the head and with a width greater than the width of the remaining part of the shaft, which shaft at the end opposite the head is provided with at least one annular groove forming a seat for the engagement of at least one locking ring, said pulling pin being placed in such a way as to allow the head and the step to be protruding with respect to the first face of the second engagement plate, from which first face the small pegs are protruding as well, the spring being interposed and kept in traction between the second face of the second engagement plate and the locking ring.

3. Device for the replacement of the removable heel, provided with pulling engagement devices, in a shoe with removable heel according to claim 1, characterised in that each hooking seat comprises at least one guide slot, of the open type and provided with at least one first side wall and an opposite second side wall, the guide slot having a suitable shape and size to allow the guiding of the head of the pulling pin, each hooking seat being provided with at least one first engagement wall and an opposite and parallel second engagement wall, where between the first engagement wall and the second engagement wall a guide opening is comprised so as to allow the sliding and the guiding of at least one part of the shaft of the pulling pin, the size of the distance between the first engagement wall and the second engagement wall being such as to be smaller than the size of the distance between the first side wall and the second side wall of the guide slot and wherein the first engagement wall and the second engagement wall are each shaped in such a way as to provide at least one oblique portion and a contiguous flat portion, the oblique portion originating from the end of the corresponding first engagement wall and second engagement wall contiguous with respect to the first side wall and to the second side wall in such a way that, during the attachment, the head of the pulling pin rests first on the oblique portion and then on the flat portion and wherein each hooking seat is made in such a way that the portion below the first engagement wall and below the second engagement wall is suitably shaped in such a way as to form an undercut perimeter area bound at least by one perimeter guide wall in such a way as to allow the passage of the head of the pulling pin.

4. Device for the replacement of the removable heel, provided with pulling engagement devices, in a shoe with removable heel according to claim 1, characterised in that each guide seat of the first engagement plate forms a semicircular groove provided with at least one flat base wall and with a contiguous inclined wall whose inclination is opposite the inclination of the oblique wall of the engagement seat, the inclined wall being inclined in the direction of the lower face and the guide seat, in correspondence of the base wall, being so deep as to equal at least the height of a small peg with which the second engagement plate is provided, wherein the inclined wall is such as to join the base wall with the surface of the lower face of the first engagement plate.

5. Device for the replacement of the removable heel, provided with pulling engagement devices, in a shoe with removable heel according to claim 1, characterised in that the guide slot of at least one hooking seat comprises at least one oblique wall, inclined in the direction of the upper face of the first engagement plate, at least one bottom wall being contiguous to the oblique wall.

6. Device for the replacement of the removable heel, provided with pulling engagement devices, in a shoe with removable heel according to claim 1, characterised in that at least the first engagement plate is provided with at least one groove at least partially filled with plastic material on which the second engagement plate is intended to at least partially rest.

7. Device for the replacement of the removable heel, provided with pulling engagement devices, in a shoe with removable heel according to claim 1, characterised in that the hooking seats are three and are arranged concentrically with respect to the engagement pin and in that the guide seats and the restraint seats are three, there being at least one circular groove surrounding the engagement pin.

* * * * *